US008356543B2

(12) United States Patent
Rosol et al.

(10) Patent No.: US 8,356,543 B2
(45) Date of Patent: Jan. 22, 2013

(54) FIREARM FIRING MECHANISM

(75) Inventors: Keith D. Rosol, Ada, MI (US); Bradford S. Bachelder, Grand Rapids, MI (US)

(73) Assignee: Defense Deisigns, LLC, Ada, MI (US)

( * ) Notice: Subject to any disclaimer, the term of this patent is extended or adjusted under 35 U.S.C. 154(b) by 295 days.

(21) Appl. No.: 12/894,509

(22) Filed: Sep. 30, 2010

(65) Prior Publication Data

US 2012/0167755 A1 Jul. 5, 2012

Related U.S. Application Data

(60) Provisional application No. 61/248,186, filed on Oct. 2, 2009.

(51) Int. Cl.

| | |
|---|---|
| ***F41A 3/26*** | (2006.01) |
| ***F41A 19/10*** | (2006.01) |
| ***F41A 19/12*** | (2006.01) |
| ***F41A 19/13*** | (2006.01) |

(52) U.S. Cl. ..... 89/188

(58) Field of Classification Search ..... 89/180, 89/184, 185, 188; 42/69.02

See application file for complete search history.

(56) References Cited

U.S. PATENT DOCUMENTS

| | | | | |
|---|---|---|---|---|
| 2,789,478 | A | | 4/1957 | McColl |
| 2,941,449 | A | | 6/1960 | Reed |
| 2,971,441 | A | | 2/1961 | Reed |
| 3,595,128 | A | | 7/1971 | Hoyt, Jr. |
| 3,611,866 | A | | 10/1971 | Jacolucci |
| 3,618,457 | A | * | 11/1971 | Miller ..... 89/185 |
| 3,893,369 | A | | 7/1975 | Benelli |
| 4,066,000 | A | * | 1/1978 | Rostocil ..... 89/198 |
| 4,164,890 | A | * | 8/1979 | Elmore et al. ..... 89/185 |
| H144 | H | * | 10/1986 | Savioli ..... 89/142 |
| 4,856,217 | A | | 8/1989 | Benelli |
| 4,930,238 | A | | 6/1990 | Poff, Jr. |
| 5,920,028 | A | | 7/1999 | Guhring et al. |
| 6,101,919 | A | | 8/2000 | Murello |
| 6,564,491 | B2 | | 5/2003 | Murello |
| 6,742,434 | B1 | | 6/2004 | Dillon |
| 7,107,715 | B2 | * | 9/2006 | Keeney et al. ..... 42/16 |
| 7,131,367 | B1 | | 11/2006 | Boerschig et al. |
| 2009/0019754 | A1 | | 1/2009 | Moretti |
| 2010/0005956 | A1 | * | 1/2010 | Wossner ..... 89/188 |
| 2010/0319527 | A1 | * | 12/2010 | Giefing ..... 89/185 |

* cited by examiner

*Primary Examiner* — Bret Hayes

(74) *Attorney, Agent, or Firm* — Gardner, Linn, Burkhart & Flory, LLP

(57) ABSTRACT

A semiautomatic firearm and firearm firing mechanism includes a bolt assembly having a bolt body coupled to a locking head for imparting a dwell in the sequence or process of bullet casing ejection, reloading, and re-cocking sequence during firing of the firearm. The locking head and bolt body rotate relative to one another as they translate longitudinally relative to one another, owing to corresponding engagement members. The locking head includes an additional engaging member for engagement with a corresponding engaging member along an inner surface of a fire control housing that houses the firing mechanism, so that the rotation and longitudinal translations of the locking head are performed in a controlled manner, which further controls the movement of the locking head and the bolt body relative to one another. A striker is released by a sear, which is coupled to a trigger, to initiate the firing and reloading/re-cocking sequence.

23 Claims, 10 Drawing Sheets

FIREARM FIRING MECHANISM

CROSS REFERENCE TO RELATED APPLICATION

The present application claims the priority benefit of U.S. provisional application Ser. No. 61/248,186, filed Oct. 2, 2009, which is hereby incorporated herein by reference in its entirety.

FIELD OF THE INVENTION

The present invention relates generally to firearms, and in particular, to semiautomatic firing mechanisms.

BACKGROUND OF THE INVENTION

Semiautomatic firing mechanisms for firearms use some of the energy of combustion gases from firing a bullet to eject the spent bullet casing, load a fresh cartridge into the firing chamber, and re-cock the firing mechanism so that the fresh cartridge may be subsequently fired, and the cycle repeated. To maximize the energy imparted to a bullet, and to enhance the accuracy of the fired bullet, it is often desirable to provide a "dwell" such that the spent bullet casing remains substantially in place immediately after the bullet is fired, before the reloading and re-cocking sequence is substantially begun.

SUMMARY OF THE INVENTION

The firearm firing mechanism of the present invention may be adapted for use on substantially any firearm in which semiautomatic operation is desired, such as a rifle, shotgun, or hand gun, and may be particularly well suited for relatively small or compact firearms, such as pistols, carbines, and the like, owing to its compactness and substantial lack of exterior moving parts. When incorporated into a firearm, the firing mechanism of the present invention facilitates the use of larger caliber ammunition than would otherwise typically be possible in smaller firearms, eliminates certain external moving parts that can present a safety hazard and/or limit the accuracy and/or limit the environments in which the firearm may be operated, and increases reliability by reducing the number of moving parts and the number and size of entry points for contaminants that can foul the firing mechanism's internal components. The firearm mechanism imparts a dwell or time delay to the reloading and re-cocking sequence, which follows the firing of a bullet, by way of mechanical interactions between bolt components and a fire control housing.

According to one form of the present invention, a firing mechanism for a firearm includes a fire control housing, a bolt assembly including a bolt body and a bolt locking head, a first rotational engaging member along a surface of the bolt body, a second rotational engaging member along a surface of the bolt locking head, a third rotational engaging member disposed along an inner surface of the fire control housing, and a fourth rotational engaging member disposed along an outer surface of the bolt locking head. The fire control housing defines a longitudinal bore in which the bolt assembly is movably received. The second rotational engaging member of the locking head engages the first rotational engaging member of the bolt body to impart rotation of the locking head, relative to the bolt body, when a longitudinal force is applied to the bolt body. The fourth rotational engaging member of the locking head engages the third rotational engaging member of the fire control housing to initially permit rotation, and to subsequently permit longitudinal translation, of the locking head relative to the fire control housing when a longitudinal force is applied to the locking head. The bolt body has a forward end portion that abuts the rear end of a bullet cartridge, so that firing the bullet cartridge imparts a rearward longitudinal reaction force against the forward end portion of the bolt body. The rearward reaction force causes the bolt body to move rearwardly relative to the locking head, which causes the locking head to rotate due to engagement of the first and second rotational engagement members. Rotation of the locking head corresponds to rotation of the fourth engagement member, which initially rotates relative to the fire control housing, and subsequently translates rearwardly relative to the fire control housing, due to its engagement with the third rotational engaging member. The initial rotation of the locking head, followed by longitudinal translation of the entire bolt assembly, imparts a dwell time between firing the bullet cartridge and substantial rearward movement of the bolt assembly relative to the fire control housing.

In one aspect, the bolt body defines a second longitudinal bore, with the locking head movably disposed in the second longitudinal bore of the bolt body.

In another aspect, the second rotational engaging member is a first helical groove, the first rotational engaging member is a first radial projection that extends at least partially into the first helical groove, the third rotational engaging member is a second groove, and the fourth rotational engaging member comprises a second radial projection extending at least partially into the first helical groove.

In yet another aspect, the second groove includes a forward partial-annular portion that permits rotational motion of the second radial projection, and includes a rearward longitudinal portion that permits longitudinal translation of the second radial projection. Optionally, the second groove is generally L-shaped.

In still another aspect, the firing mechanism includes a biasing member disposed between the bolt body and the locking head, which urges the bolt body and the locking head longitudinally away from one another.

In a further aspect, the firing mechanism is incorporated into a firearm with a trigger mechanism for actuating the firing mechanism.

According to another form of the present invention, a telescoping striker assembly, provided for striking a firing pin of the firing mechanism of a firearm, includes a striker head telescopingly engaged by a striker rear portion with a biasing member disposed between the striker head and striker rear portion. Optionally, the striker head and striker rear portion are hollow, with the biasing member disposed internally to the striker head and rear portion. A striker middle section may be provided between the striker head and the rear portion, with a retainer member provided to limit the extent to which the striker rear portion can telescopingly extend away from the striker head. Optionally, the biasing member is a pair of coil springs including a smaller-diameter spring disposed inside of a larger-diameter spring.

Thus, the present invention provides a firearm firing mechanism that is operable to fire a bullet from a cartridge, where the bolt assembly remains substantially in place during the initial stage of firing (i.e. exhibits a dwell or time delay), after which the bolt assembly cycles through a reloading operation in preparation for firing a fresh bullet cartridge. Substantially all of the moving parts of the firing mechanism are contained within a fire control housing that remains stationary during operation of the firearm, such that the firearm has relatively few external moving parts.

These and other objects, advantages, purposes, and features of the present invention will become apparent upon review of the following specification in conjunction with the drawings.

DESCRIPTION OF THE PREFERRED EMBODIMENTS

The present invention is directed to a semiautomatic firing mechanism for a firearm, which permits firing a plurality of bullets from a firearm in rapid succession, without need for manual re-cocking of the firing mechanism between shots. While the present invention is described with reference to a firearm in the form of a semiautomatic pistol, it should be understood that the same or similar principles may be used for other firearms that use semiautomatic firing mechanisms. As will be more fully described below, the semiautomatic firing mechanism includes a bolt assembly including a locking head that interacts with both a bolt body and a fire control housing to impart a "dwell" or time delay between the firing of a bullet and cycling through the process of discharging the spent bullet casing and reloading a fresh cartridge into the firing chamber. A fire control housing forms the upper portion of the pistol and remains substantially stationary during operation of the firearm, with the firing mechanism components being internal to the fire control housing, such that there are substantially no external moving parts that can present a safety hazard to a user, and such that there is little susceptibility to contamination to limit the types of environments in which the firearm may be operated. In addition, accuracy and reliability are enhanced by using a stationary barrel and by reducing the number of moving parts and the number and size of entry points for external contaminants to foul the firing mechanism's internal components.

Figure 1:
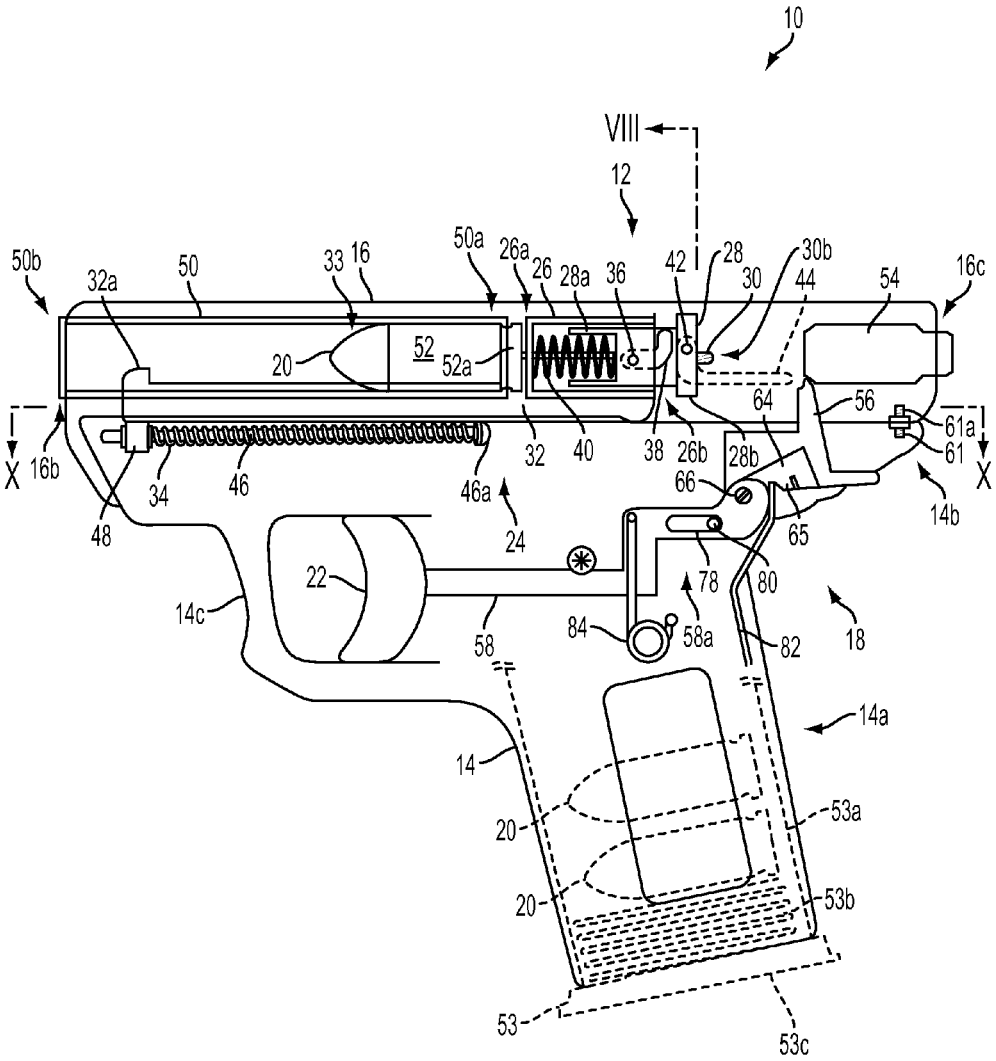
FIG. 1 is a side and partial cutaway view of a pistol incorporating a firing mechanism in accordance with the present invention.

Referring now to FIG. 1, a firearm 10, such as a pistol, incorporates a semiautomatic firing mechanism 12. Firearm 10 includes a frame 14 that supports the mechanisms and components of the firearm, including firing mechanism 12, which is housed inside a fire control housing 16, and a trigger mechanism 18. Trigger mechanism 18 is operable to actuate or initiate cycling action of the semiautomatic firing mechanism 12 for repeated discharge of bullets 20 from firearm 10.

Firing mechanism 12 includes a bolt assembly 24 made up of a bolt body 26, a locking head 28, a firing pin 30, and a bolt carrier 32 including bolt return springs 34 (FIGS. 1-4). In the illustrated embodiment, bolt body 26 is a generally hollow cylinder having a forward end portion 26*a* that abuts or is in close proximity to the rear end of a bullet cartridge 33 prior to firing of the bullet 20. An aft or rear end 26*b* of bolt body 26 is open and telescopingly receives a forward portion 28*a* of locking head 28 that is generally cylindrical in shape and sized to fit in the hollow opening of bolt body 26. Bolt body 26 and locking head 28 include corresponding rotational engaging members that cause locking head 28 to rotate relative to bolt body 26 when the locking head 28 is moved longitudinally relative to the bolt body. Firing pin 30 is slidably received within aligned central bores 35 (FIG. 8) in locking head 28 and bolt body 26, and extends through forward end 26*a* of bolt body 26 during the firing sequence, which will be described in detail below.

Figure 2A:
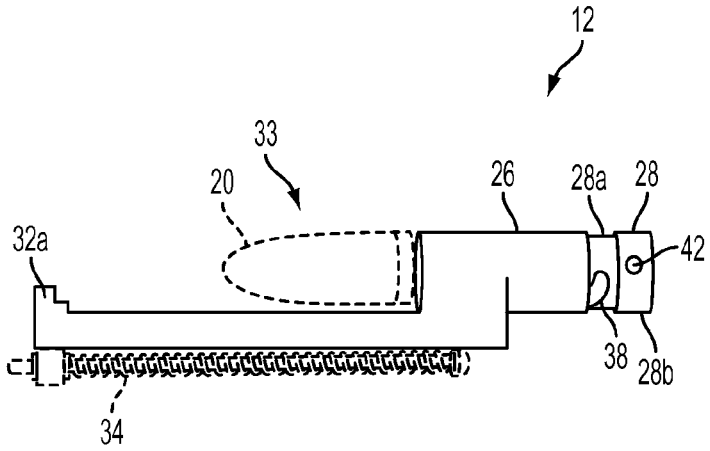
FIG. 2A is a side perspective view of a bolt assembly.
Figure 2B:
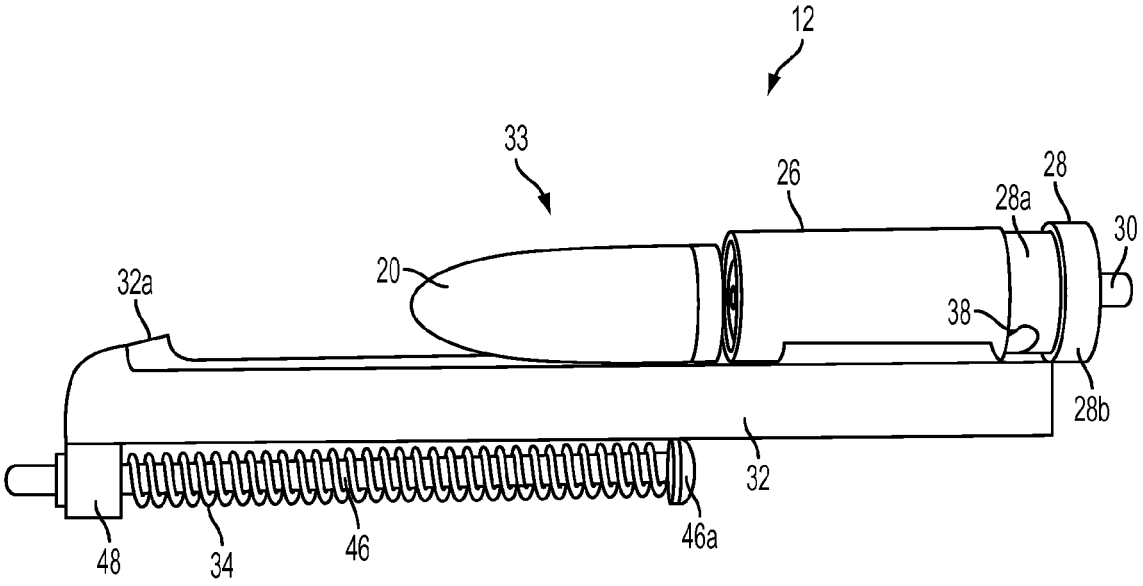
FIG. 2B is a side perspective view of another bolt assembly.
Figure 3A:
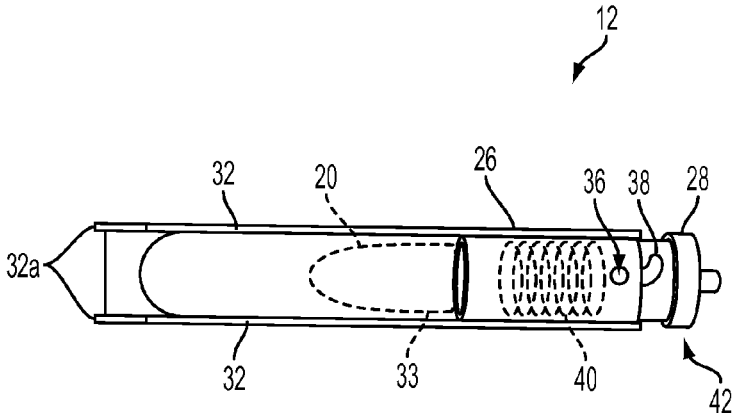
FIG. 3A is a top perspective view of the bolt assembly of FIG. 2A.
Figure 3B:
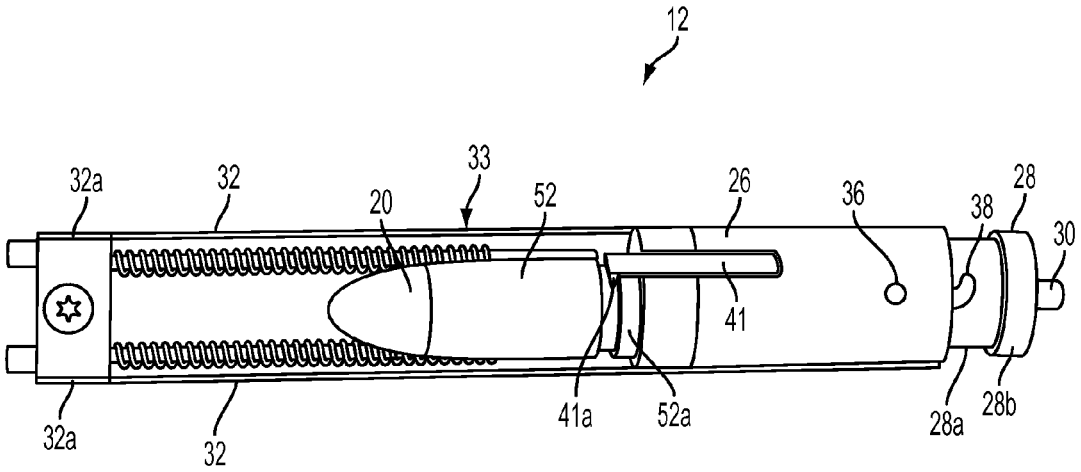
FIG. 3B is a top perspective view of the bolt assembly of FIG. 2B.
Figure 4:
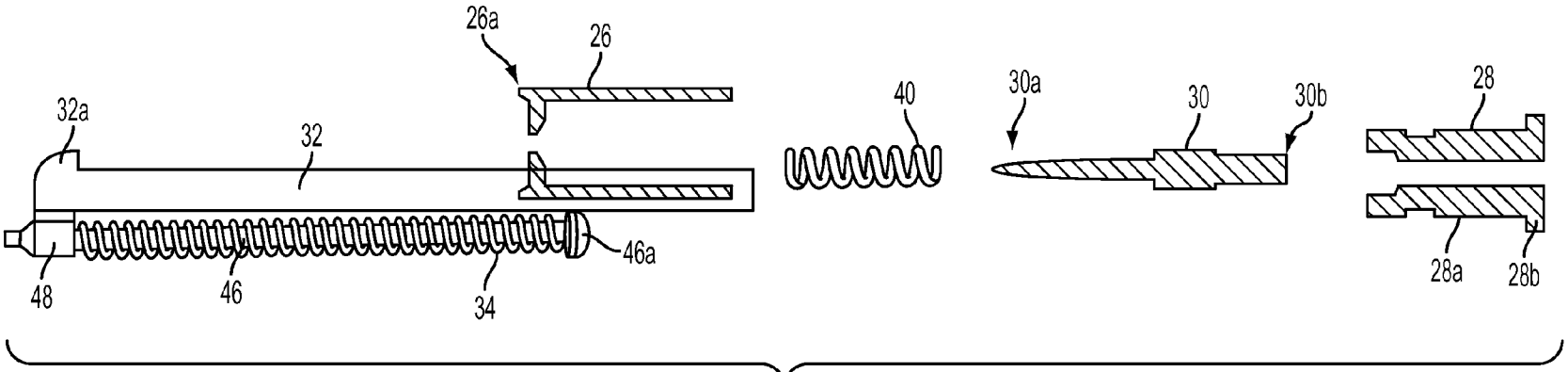
FIG. 4 is a side elevation and partial sectional exploded view of the bolt assembly of FIG. 2B.

As is best seen in FIGS. 1, 2A, and 3A, bolt body 26 includes a first rotational engaging member in the form of a pin or protrusion 36 that extends radially into the hollow opening formed by bolt body 26 and into engagement with a second rotational engaging member in the form of a groove 38 in the outer surface of locking head 28. Groove 38 is generally helical or curved in shape so that longitudinal telescopic motion of locking head 28 relative to bolt body 26 causes the locking head 28 to rotate about its longitudinal axis. Groove 38 is closed-ended so that locking head 28 is inseparable from bolt body 26 when pin 36 is installed through bolt body 26 and disposed in groove 38. A biasing member 40, such as a coil spring or the like, is disposed between bolt body 26 and locking head 28, and is held in compression to bias locking head 28 outwardly from the bolt body 26.

Optionally, bolt body 26 further includes an extractor element 41 (FIGS. 3B and 14E) along or recessed in an outer surface of the bolt body, the extractor element 41 projecting or extending longitudinally forwardly from the bolt body. Extractor element 41 is arranged along an upper-right portion of bolt body (as viewed from directly behind), and includes a radially-inwardly directed finger 41*a* that is disposed over an upper-right portion of the rear flange 52*a* of bullet casing 52 (such as engaging a groove between the bullet casing and the casing's rear flange) when cartridge 33 is positioned in breech portion 50*a* of barrel 50. Extractor element 41 holds rear flange 52*a* in abutment with or in close proximity to the forward end 26*a* of bolt body 26 during cycling of bolt assembly 24, and works cooperatively with firing pin 30 (after the firing of bullet 20) to eject the spent casing 52 from the firearm, as will be described below.

Locking head 28 includes an aft flange portion 28*b* having a diameter greater than the opening in rear end 26*b* of bolt body 26 for limiting the longitudinal extent to which locking head 28 may be inserted into bolt body 26. Inner surface 17 of fire control housing 16 includes a third rotational engaging member in the form of a groove 44, which receives a fourth rotational engaging member in the form of a radial pin or protrusion 42 along an aft flange portion 28*b* of locking head 28. It will be appreciated that each rotational engaging member may be substantially any element, feature, or shape configured to impart or permit rotational and/or longitudinal translation between the firing mechanism components on which corresponding engaging members are established.

Figure 10:
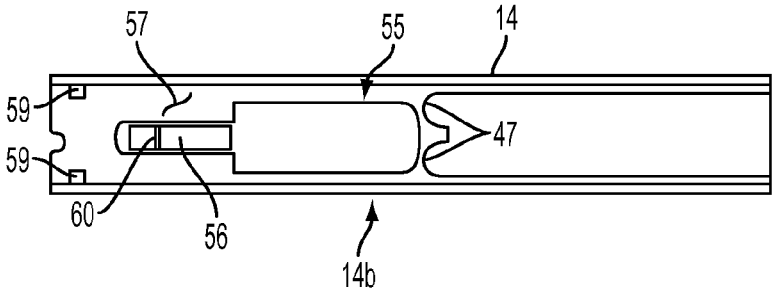
FIG. 10 is a top plan view of the firearm frame, taken along section line X of FIG. 1.

Bolt body 26 is coupled to bolt carrier 32, which comprises a pair of rails slidably disposed along an upper portion of frame 14 and inside of fire control housing 16. Optionally, bolt body 26 and bolt carrier 32 are unitarily formed. Bolt carrier 32, bolt body 26, and locking head 28 are biased toward a forward or ready-to-fire position, such as shown in FIG. 1, by a pair of bolt return springs 34 (FIGS. 1, 2A, 2B, 3B, 4, and 14A-14E), which are held respectively in compression along a pair of return spring shafts 46. Return spring shafts 46 have flange portions 46*a* at their rear ends, which are held substantially stationary by shoulder portions 47 (FIG. 10) along the upper surface of frame 14 during operation of the firearm 10. Bolt carrier 32 includes a pair of adjacent slide portions 48 at a forward end thereof, the slide portions 48 each having a longitudinal bore for slidably receiving a respective one of the return spring shafts 46. Bolt return springs 34 are thus held in compression between slide portions 48 of bolt carrier 32 and head portions 46*a* of return spring shafts 46, and are compressed when cartridge 33 is fired and firing mechanism 12 is cycled, causing bolt carrier 32 to move rearwardly within fire control housing 16, as explained below. Bolt return springs 34 need not have a particularly high spring coefficient (such as to resist strong recoil or reaction forces from casing 52) because a significant amount of recoil energy is absorbed by the cycling of locking head 28 relative to bolt body 26 and fire control housing, and the re-cocking sequence, as will be described below. Optionally, a bolt carrier projection 32*a* is provided on each rail of bolt carrier 32 for engaging respective shoulders along interior surface 17 of fire control housing 16 as bolt assembly 24 reaches its rearmost position during cycling. Bolt carrier projections 32*a* thus limit the amount of compression of bolt return springs 34 and, therefore, limit the forces applied to return spring shafts 46, which protects the shafts 46 and springs 34 from damage.

Figure 8:
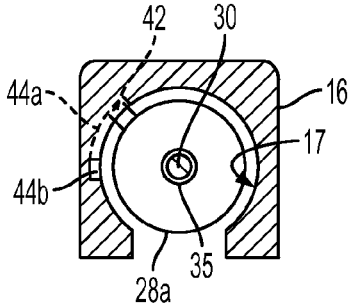
FIG. 8 is a rear sectional view of the fire control housing taken aft of the locking head along section line VIII of FIG. 1.

Fire control housing 16 is a generally hollow structure that forms the upper portion of firearm 10. Fire control housing 16 includes grooves or other attachment elements 49 (FIG. 9) for releasably coupling fire control housing 16 along an upper surface of frame 14. Fire control housing includes groove 44 along contoured inner surface 17 (FIGS. 1 and 8), which also receives and supports a barrel 50 at its forward end, the barrel remaining substantially fixed relative to fire control housing 16 and frame 14 during firing. Fire control housing 16 further receives and supports or guides bolt assembly 24, which slides fore and aft during firing. Along an upper/side surface of fire control housing 16, conventionally located on the right-hand side when viewed from behind the firearm 10, is a casing ejection aperture 16*a* (FIG. 9) through which spent bullet casings are ejected (FIG. 14E) during operation of the firearm. A front aperture 16*b* in fire control housing 16 permits barrel 50 to protrude therethrough, while a rear aperture 16*c* permits attachment of a striker cap, as will be described below. Groove 44 includes a partial-annular or radial portion 44*a* and a longitudinal portion 44*b* for guiding pin 42 (FIGS. 1 and 8). Optionally, the fire control housing may be made of light weight materials, such as polymer and/or resinous or ceramic materials or the like, with the groove for guiding pin 42 made up of a reinforced or strengthened or hardened material (such as steel) to provide a wear-resistant surface for pin 42.

Figure 6:
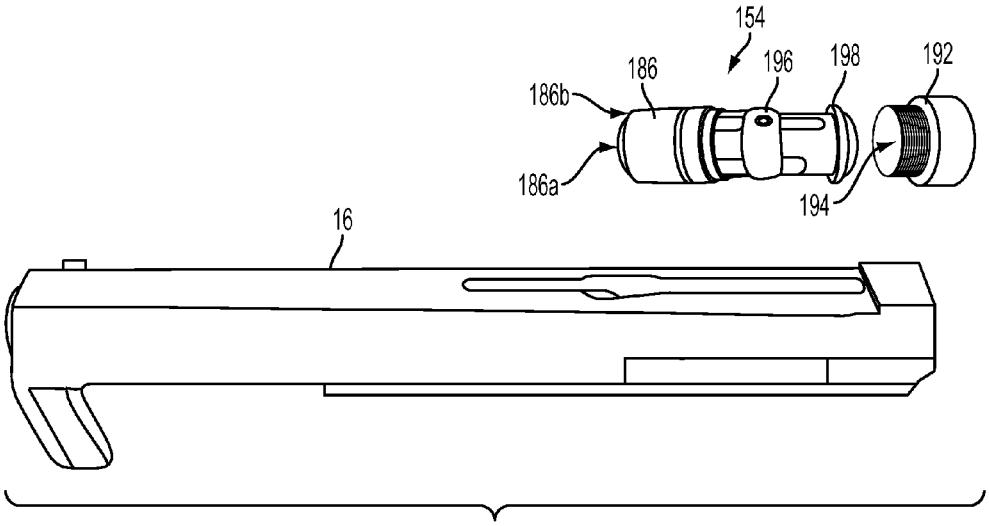
FIG. 6 is a side perspective view of a fire control housing, an alternative striker, and a striker cap.

Although fire control housing 16 of FIG. 6 includes additional apertures, it will be appreciated that the only exposed apertures in fire control housing 16 that are necessary for the operation of firearm 10 are the front aperture 16*b* (for expelling bullets and/or supporting a protruding end of barrel 50) and the casing ejection aperture 16*a*. Because fire control housing 16 does not move relative to frame 14 during firing, the tolerances for the attachment surfaces that couple fire control housing 16 to frame 14 may be relatively tight to limit or prevent the intrusion of foreign matter or debris into firing mechanism 12. The intrusion of foreign matter or debris is further limited by the existence of only two open apertures in fire control housing 16. Of these, front aperture 16*b* is substantially occupied by barrel 50, while casing ejection aperture 16*a* may be covered during most phases of operation (except casing ejection) by bolt body 26. Optionally, such as for military weapons or weapons intended for use in particularly dusty or dirty environments, a supplemental flap (not shown) may be pivotably or movably coupled to a surface of the fire control housing to selectively cover the casing ejection aperture 16*a* when the weapon is not actively being fired.

Cartridge 33, including bullet 20 and bullet casing 52, is initially supported inside barrel 50 at a breech portion 50*a*, inside of fire control housing 16, prior to discharge of the bullet through a muzzle end 50*b* of the barrel 50. Barrel 50 is supported in fire control housing 16 with muzzle end 50*b* extending at least partially through an opening in the forward end of fire control housing 16. The barrel has a first inner diameter at a rearward end portion of the barrel, substantially corresponding to the diameter of the casing 52, and a second inner diameter at a forward end portion of the barrel substantially corresponding to the diameter of the bullet 20 and defining the caliber of the firearm. The bullet 20 has a smaller outer diameter than that of the bullet casing 52 in which the bullet is supported. A shoulder or "case mouth" 50*c* inside the barrel (FIGS. 14A-E) defines the transition from the first and second inner diameters of the barrel, and prevents the cartridge from entering the barrel beyond the extent at which the forward end of the casing contacts the shoulder, as is known in the art. The bullet casing 52 includes a rear flange 52*a* (which may be a "rebated rim" having a smaller flange diameter than the rest of the casing), and typically includes a centrally-located primer cap (not shown) to ignite a charge of gunpowder or other explosive substance contained in bullet casing 52. Prior to firing, rear flange 52*a* abuts or is in close proximity to forward end 26*a* of bolt body 26, with a forward nose 30*a* (FIG. 4) of firing pin 30 extending through end 26*a* and aligned centrally with the primer cap in rear flange 52*a*. After firing, extractor 41 (FIGS. 3B and 14E) draws casing 52 out of breech portion 50*a* of barrel 50, after which the casing is ejected by extractor 41 and firing pin 30 in a manner that will be described below.

Frame 14 may be substantially conventional in design, including a handle or grip portion 14*a* that houses a magazine 53 containing fresh cartridges 33 (a portion of which is shown in phantom in FIG. 1), and an upper longitudinal portion 14*b* that supports fire control housing 16 and firing mechanism 12. Frame 14 includes a number of conventional elements, such as a trigger guard 14*c* at an upper region of grip portion 14*a*, and a cartridge aperture 55 in an upper surface 57 of upper longitudinal portion 14*b* (FIG. 10), through which the fresh cartridges 33 from magazine 53 are directed before they are individually loaded into breech portion 50*a* of barrel 50 in a manner that will be described below.

Figure 9:
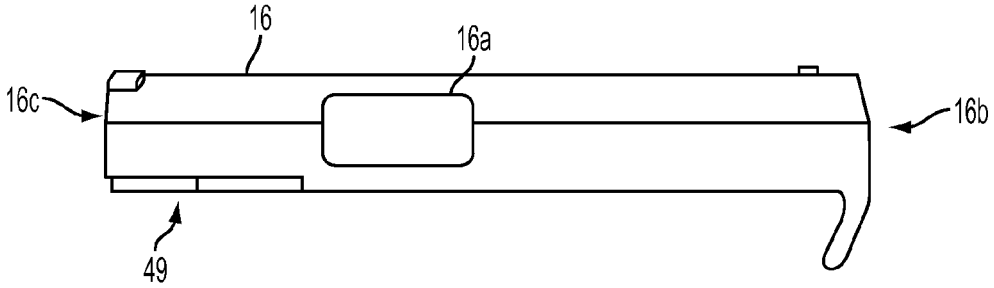
FIG. 9 is a right side elevation of the fire control housing.

In the illustrated embodiment, retaining tabs 59 are provided along upper surface 57, at or near a rear portion thereof, for slidably engaging attachment elements 49 of fire control housing 16 (FIG. 9). A housing release element 61, such as a spring-loaded pin or plunger, is positioned at the rear end portion of upper longitudinal portion 14*b* of frame 14 (FIG. 1) and serves as a "take-down" device for releasably retaining fire control housing 16 at a fixed longitudinal position relative to housing 16. A biasing member 61*a*, such as a coil spring, is positioned along the housing release element 61 to bias the release element in a manner that engages an aperture in a lower surface of the fire control housing. By depressing housing release element 61 from underneath the upper longitudinal portion 14*b* of frame 14 (such as with a narrow tool), release element 61 disengages the fire control housing 16 sufficiently to permit the housing 16 to slide longitudinally relative to frame 14 until retaining tabs 59 disengage attachment elements 49, at which point fire control housing 16 may be removed from upper longitudinal portion 14*b* of frame 14 in a vertical direction (as viewed in FIG. 1).

Magazine 53 is also substantially conventional, including a housing portion 53*a* that is sized and shaped to hold a plurality of fresh cartridges 33, and to be slidably received in handle portion 14*a* of frame 14 (FIG. 1). A magazine spring 53*b* is compressed between the lowermost cartridge 33 in housing 53*a* and a base plate 53*c* of housing. The magazine spring 53*b* urges fresh cartridges 33 upwardly toward cartridge aperture 55 in upper surface 57 of frame 14. A thumb-actuated magazine release mechanism (not shown) releasably fixes magazine 53 inside handle portion 14*a* of frame 14. Upon depressing a button of the magazine release mechanism, magazine 53 drops or is removable from handle portion 14*a* of frame 14, such as in a manner that is well known in the art.

Figure 12A:
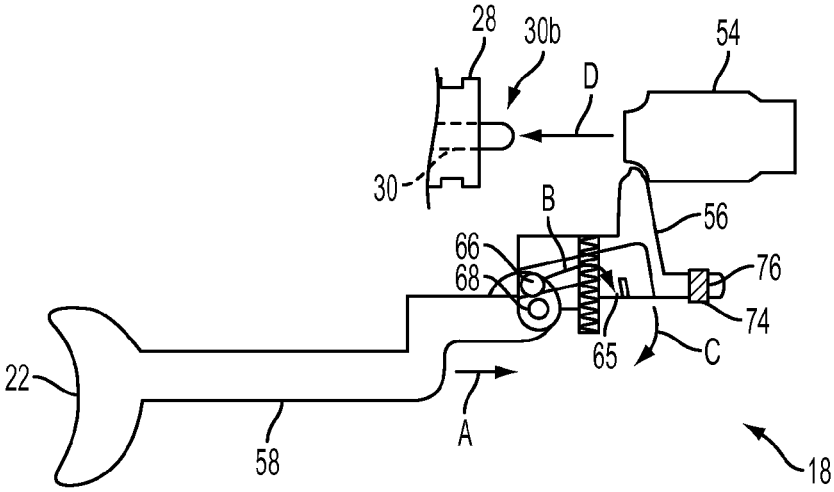
FIG. 12A is a side elevation of a trigger mechanism for use with the firing mechanism of the present invention, in a cocked or ready-to-fire configuration.
Figure 12B:
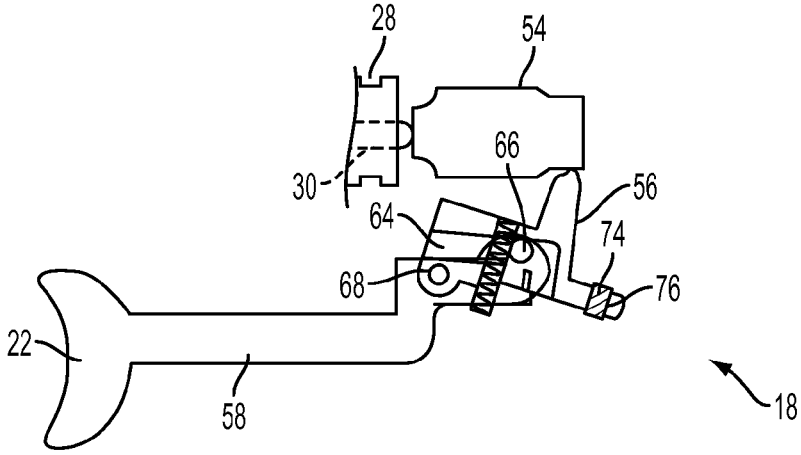
FIG. 12B is a side plan view of the trigger mechanism of FIG. 12A, in a just-fired configuration.
Figure 13:
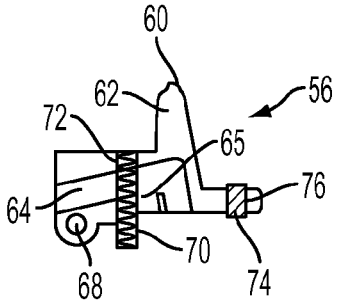
FIG. 13 is a side plan view of a sear for use in the trigger mechanism of FIGS. 12A and 12B.

With reference to FIGS. 1, 12A, 12B, 13, and 14A-14E, trigger mechanism 18 includes a striker assembly 54 for striking the rear end 30*b* of firing pin 30, a sear 56 for releasing striker assembly 54 upon actuation of trigger 22, and a drawbar 58 for actuating the sear 56 via trigger 22. Sear 56 includes a latch nose 60 at the end portion of an upward projection 62, the latch nose 60 for releasably engaging a front recessed portion of striker assembly 54 (FIG. 13). Sear 56 also includes a striker-release guide channel or groove 64 set at an angle relative to upward projection 62, which is configured to receive a tracking projection 66 at the rear or aft end of drawbar 58. A sear-disconnect or return channel or groove 65 is disposed at an aft or rear portion of striker-release guide channel 64 for disengaging tracking projection 66 from striker-release guide channel 64 so that sear 56 is free to be biased upwardly to re-engage striker assembly 54 after firing (FIGS. 12B and 14E), and also for providing a return path for tracking projection 66 to return to the forward portion of striker-release guide channel 64 (FIG. 12A).

Tracking projection 66 may include a biasing member or spring device (not shown) that urges the tracking projection from a rear portion of striker-release guide channel 64 into a top portion of return channel 65, which guides tracking projection 66 back to the forward end of striker-release guide channel 64. A pivot 68 couples sear 56 to frame 14 so that sear 56 is permitted to pivot between a cocked or ready-to-fire position (FIGS. 1, 12A, and 14A) and a post-firing position (FIGS. 12B, 14D, and 14E). A biasing member such as a sear spring 70 is inserted into a bore 72 of sear 56 that is open at the sear bottom. Sear spring 70 biases the sear 56 upwardly into the cocked position when the sear is not forced downwardly by tracking projection 66, i.e., after tracking projection 66 enters return channel 65. Optionally, an adjustment screw 74 is provided in a threaded bore 76 at a distal end of sear 56, spaced from pivot 68, to permit fine adjustments of the orientation of sear 56 in the cocked position (FIG. 12A).

Trigger 22, drawbar 58, and tracking projection 66 move longitudinally fore and aft with the actuation of trigger 22 by a user. This motion is guided in part by a guide channel 78 near an aft end portion 58*a* of drawbar 58 (FIG. 1). Guide channel 78 receives a stationary guide pin 80 mounted to frame 14. Guide channel 78 and guide pin 80 ensure that the fore and aft movement of drawbar 58 is substantially longitudinal so that tracking projection 66 urges sear 56 to pivot downwardly as the tracking projection 66 travels through striker-release guide channel 64 of sear 56, against the biasing force of sear spring 70.

A drawbar return spring 82 is mounted in an aft handle or grip portion of frame 14, and extends upwardly along an aft surface of the aft end portion 58*a* of drawbar 58. Drawbar return spring 82 biases the drawbar 58 forwardly against the rearward pulling force of a user upon trigger 22. A disconnector spring 84 is also mounted in the handle portion of frame 14, and is coupled to aft end portion 58*a* of drawbar 58, forward of guide channel 78. By pulling downwardly and forwardly on aft end portion 58*a* of drawbar 58, disconnector spring 84 ensures that tracking projection 66 exits striker-release guide channel 64 and enters return guide channel 65 after trigger 22 is pulled back far enough that striker assembly 54 is released.

Figure 5:
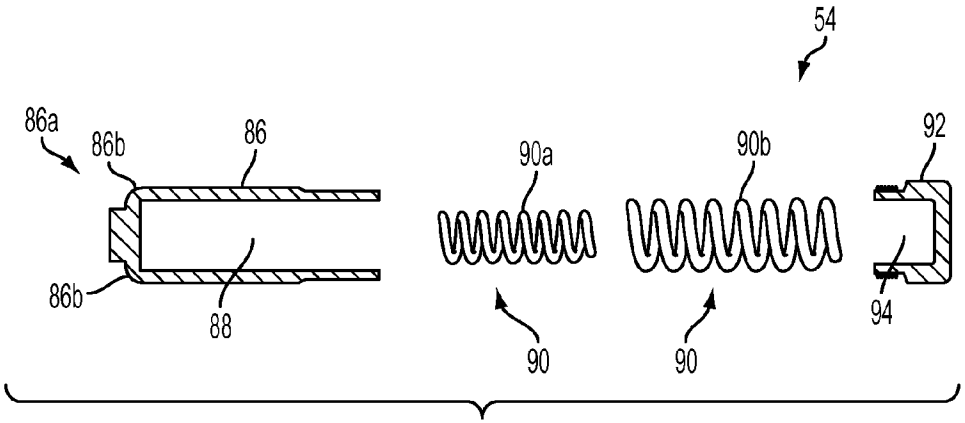
FIG. 5 is a side plan and partial sectional exploded view of a striker.

Striker assembly 54 includes a striker body 86 having a weighted head portion 86*a* for striking rear 30*b* of firing pin 30 (FIG. 5). Striker body 86 is generally hollow and cylindrical in shape, and forms a chamber or recess 88 for receiving one or more striker springs 90 in compression when striker assembly 54 is held in the cocked or ready-to-fire position of FIGS. 1 and 12A. Striker body 86 includes forward shoulder portions 86*b*, at weighted head portion 86*a*, for engaging latch nose 60 of sear 56. A striker end cap 92 is threaded into a bore in the aft end of fire control housing 16, and is generally cylindrical in shape and defines a hollow chamber 94 for receiving the aft end portions of striker springs 90. In the illustrated embodiment of FIG. 5, striker springs 90 include a smaller-diameter spring 90*a* nested and telescoped inside a larger-diameter spring 90*b*. Smaller-diameter spring 90*a* has greater length than that of large diameter spring 90*b* and may have a lower spring coefficient than large spring 90*b* so that when both springs are compressed inside chamber 88 of striker body 86, large diameter spring 90*b* provides greater initial force than small diameter spring 90*a* upon striker body 86, while small diameter spring 90*a* applies its force over a greater distance of travel of striker body 86.

Figure 7A:
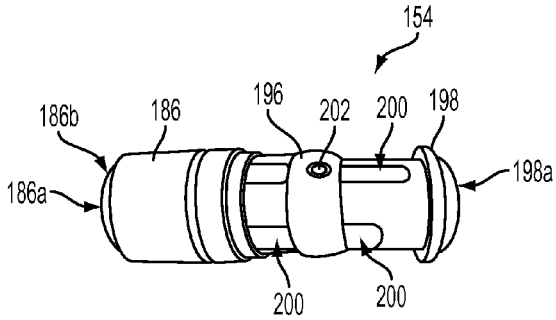
FIG. 7A is a side perspective view of the striker of FIG. 6.
Figure 7B:
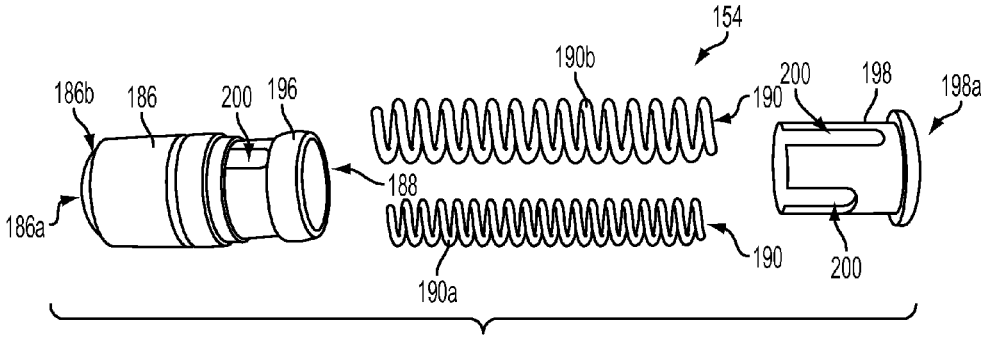
FIG. 7B is an exploded side perspective view of the striker of FIG. 6.

Optionally, an alternative telescopic striker assembly 154 includes a hollow striker head 186, a hollow midsection 196, and a hollow rear section 198 (FIGS. 6-7B). A pair of striker springs 190, including a small-diameter striker spring 190*a* telescoped within a large diameter striker spring 190*b*, are disposed inside a chamber 188 defined by striker head 186, midsection 196, and rear section 198. Striker rear section 198 is telescopingly nested inside of striker midsection 196, which in turn is telescopingly nested inside of striker head 186. Slots 200 are formed or established in striker midsection 196 and striker rear section 198 to permit air to readily enter and escape from striker chamber 188 during compression and expansion of striker 154, thereby permitting the striker 154 to readily expand and contract substantially without resistance from air entering or escaping from striker chamber 188 through incidental or small gaps between striker rear section 188, striker midsection 196, and striker head 186. At least some of slots 200 may be closed-ended slots wherein fasteners or retainer members 202 can be inserted into slots 200 to retain striker 154 as a single unit while springs 190 remained at least partially compressed while striker 154 is in an expanded state (FIG. 7A).

Striker head 186 includes a weighted head portion 186*a* and shoulder region 186*b*, substantially similar to the corresponding components of striker body 86, while striker rear section 198 includes a cap or head portion 198*a* that is sized to be received inside a chamber 194 of a striker end cap 192, similar to end cap 92. Striker 154 functions in substantially the same manner as striker assembly 54, as will be described below, but is more compact in its longitudinal direction owing to its ability to maintain springs 190 in a partially compressed state, even when striker 154 is in an expanded state, whereas striker assembly 54 includes an open-ended striker body 86 of greater length so that striker springs 90 may be supported inside chamber 88, without fully ejecting the springs from the chamber during operation.

Figure 11:
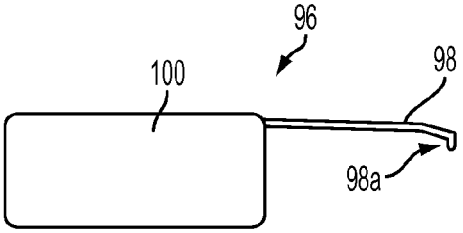
FIG. 11 is a right side elevation of a manual bolt actuator.

Optionally, firearm 10 may be provided with a manual bolt actuator 96 that is coupled to bolt assembly 24 via a retractor finger 98 (FIG. 11). Manual bolt actuator 96 includes a housing portion 100 that either replaces the rear portion of the fire control housing 16, or is slidably disposed over a rear portion of a fire control housing. Housing portion 100 may include ribs or a textured surface to facilitate gripping. A spring (not shown) biases manual bolt actuator 96 forwardly. Retractor finger 98 extends through an upper portion of the longitudinal bore of the fire control housing and engages bolt body 26, such as at forward end 26*a*. Retractor finger 98 includes a forward catch 98*a* that is disposed over and/or along a front surface of bolt body 26 so that bolt assembly 24 is free to slide rearwardly during firing of the firearm without imparting forces or motion to retractor finger 98, while manual bolt actuator 96 remains stationary relative to fire control housing 16 and frame 14 during firing. However, by grasping housing portion 100 and pulling rearwardly, a user may cycle bolt assembly 24 to eject a cartridge or casing (if present) from barrel 50, to cock sear 56 and striker assembly 54, and to load a fresh cartridge 33 into barrel 50 upon release of housing portion 100 so that the spring returns manual bolt actuator 96 to its normal position.

Accordingly, firearm 10 may be cycled through semiautomatic operation to fire a bullet from a cartridge, eject the spent bullet casing, re-cock the striker and sear, and load a fresh cartridge, while imparting a dwell or delay in the post-firing sequence to minimize motion of the firearm prior to the bullet being expelled from the muzzle and to limit or prevent fouling of the firing mechanism with powder residues. Firearm 10 begins in a cocked and ready-to-fire configuration, such as in FIGS. 1, 12A, and 14A. When cocked and ready to fire, trigger 22 and drawbar 58 and tracking projection 66 are at their forward positions, bolt assembly 24 is at its forward position with the forward end 26*a* of bolt body touching or in close proximity to rear flange 52*a* of bullet casing 52, which is positioned in breech end 50*a* of barrel 50. Pin 36 in bolt body 26 is at a forward end of curved or helical groove 38 in locking head 28, with locking head 28 biased rearwardly (to the extent permitted by pin 36 and groove 38) by spring 40. Pin 42 in locking head 28 is near the end of partial-annular portion 44*a* of groove 44 in fire control housing 16. Firing pin 30 is aligned with the primer cap in the rear flange 52*a* of bullet casing 52. Sear 56 is in its raised position with latch nose 60 engaging shoulder 86*b* of striker body 86 to hold striker body 86 in its rearward or cocked position with springs 90 compressed inside striker chamber 88. In the event that firearm 10 is not initially in the above-described cocked position, manual bolt actuator 90 may be drawn rearwardly and then released to configure firearm 10 in the cocked and ready-to-fire position.

Figure 14A:
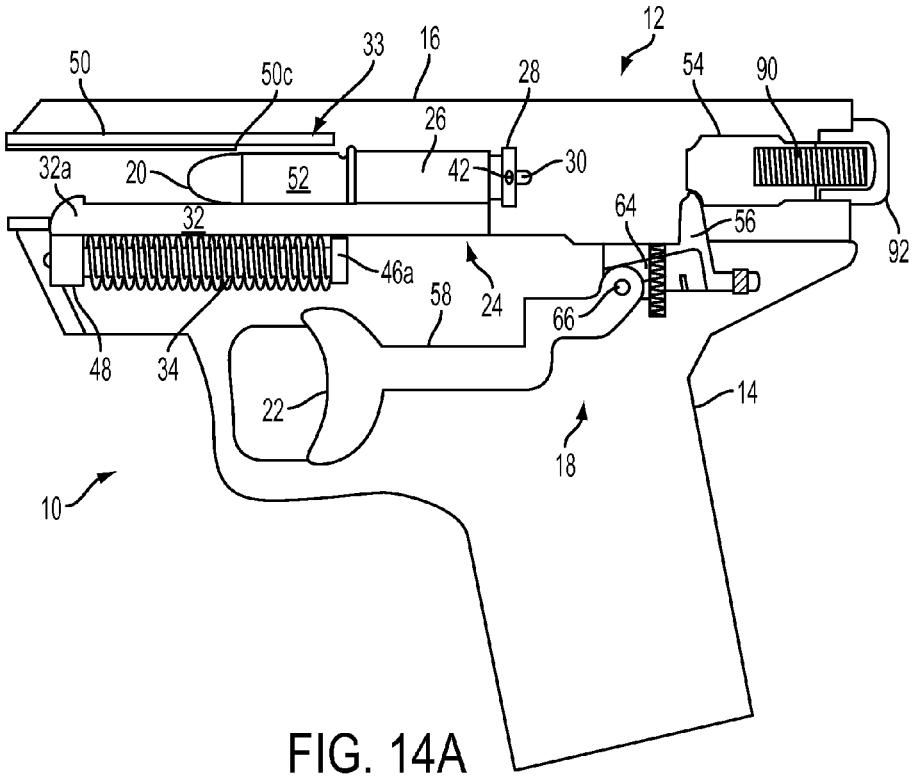
FIGS. 14A-14E are side and partial cutaway views of a pistol incorporating the firing mechanism and showing the primary stages of a semiautomatic firing, reloading, and re-cocking sequence.
Figure 14B:
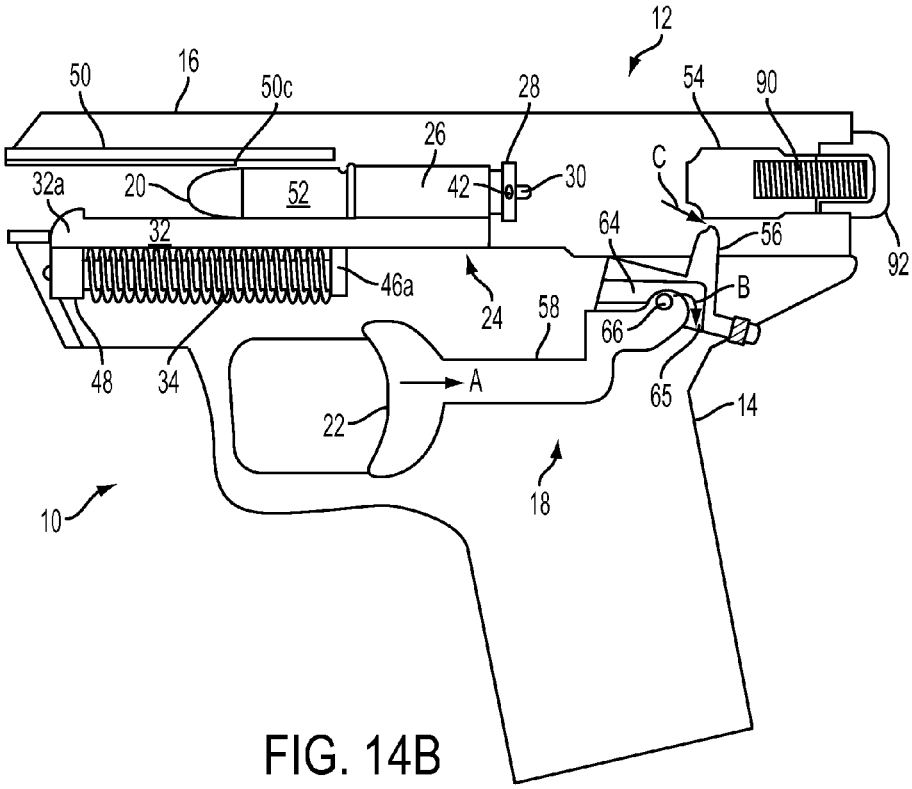
Figure 14C:
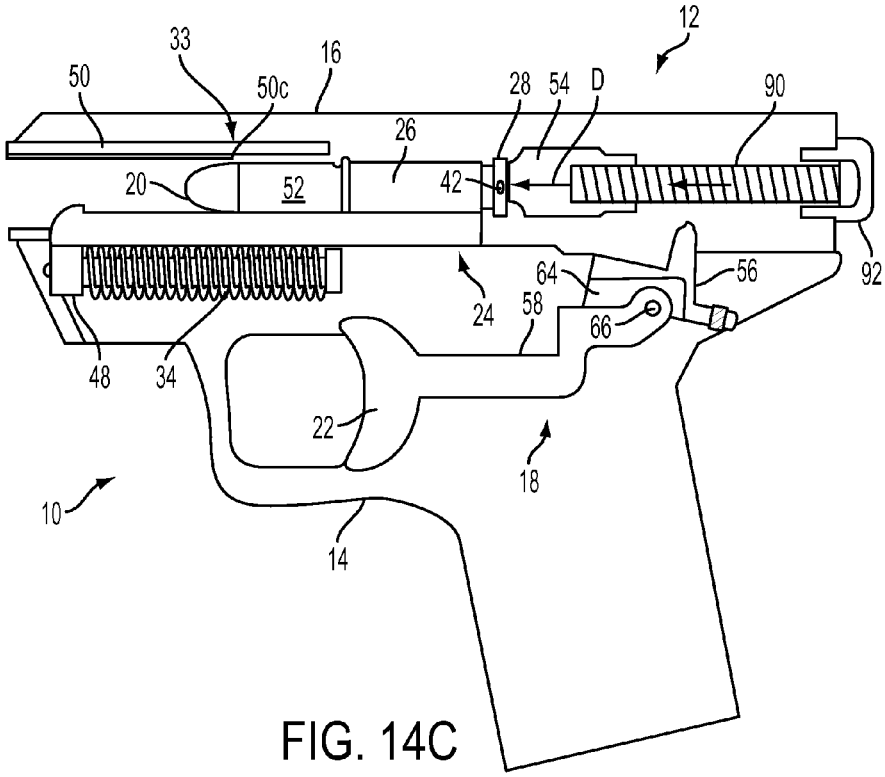
Figure 14D:
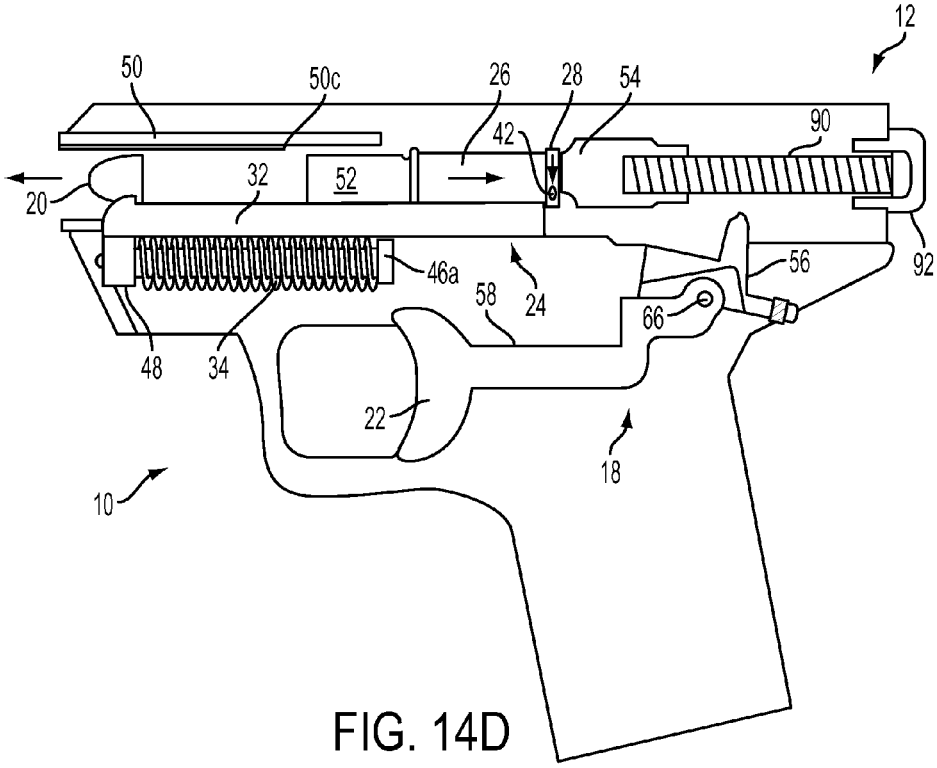
Figure 14E:
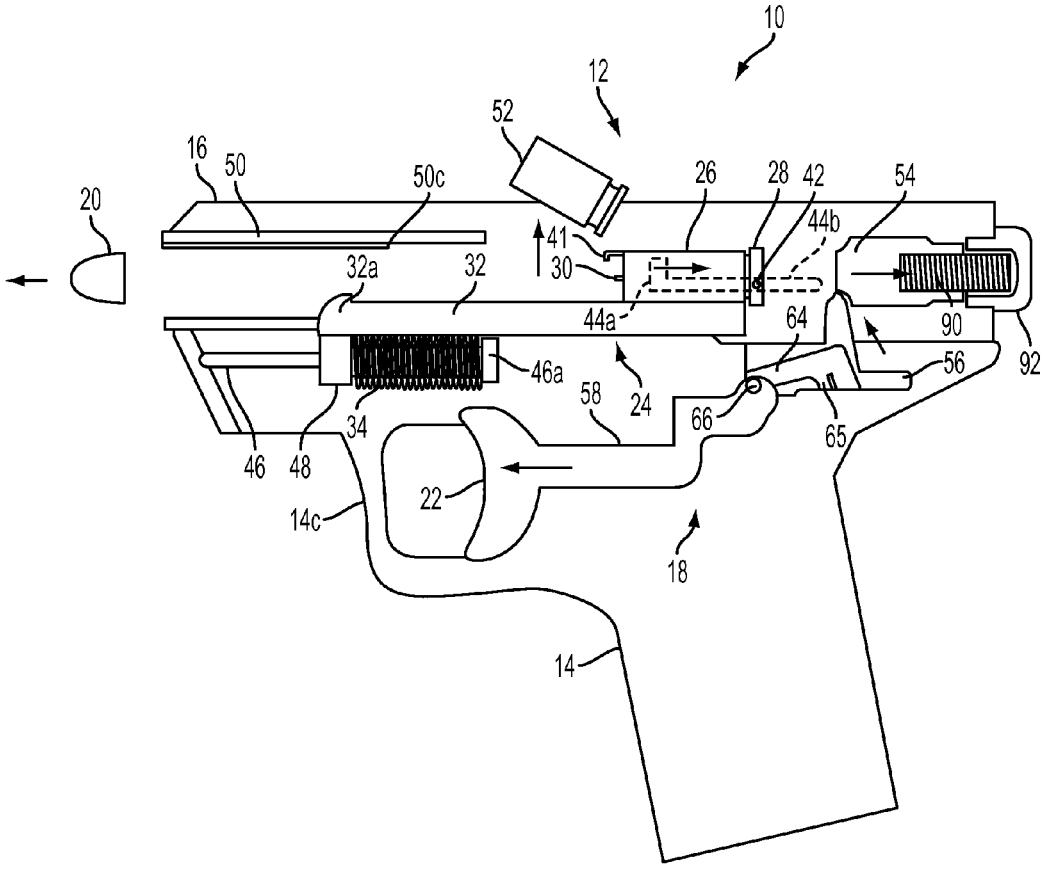

A user pulls trigger 22 rearwardly to initiate the firing, reloading, and re-cocking sequence that is labeled with arrows A-D in FIGS. 12A, 14B, and 14C. By pulling on trigger 22 in an aft direction, drawbar 58 moves rearwardly (A) against the bias of drawbar return spring 82, and is guided by guide pin 80 in guide channel 78 at aft end portion 58*a* of drawbar 58. Tracking projection 66 begins to traverse rearwardly (B), along striker-release guide channel 64 of sear 56, which causes sear 56 to pivot downwardly about pivot 68 (C) (FIGS. 12B and 14B). The downward pivoting motion of sear 56 (C) draws latch nose 60 downwardly and out of engagement with shoulder 86*b* of striker body 86, as best seen in FIG. 14B. Once latch nose 60 has cleared the striker shoulder 86*b*, striker body 86 is free to accelerate forwardly (D) under forces applied by springs 90, and is guided by contoured inner surface 17 of fire control housing 16 (FIGS. 12B and 14C). Springs 90 push against striker end cap 92, which remains stationary, as they accelerate striker body 86 longitudinally forward, with springs 90 typically remaining at least partially inside of chamber 88 throughout the operation of firing mechanism 12.

Striker body 86 or striker assembly 54 is propelled forward so that weighted head portion 86*a* impacts rear 30*b* of firing pin 30 with sufficient force to impact the primer cap in the rear flange 52*a* of the casing 52 of cartridge 33 and cause ignition of the charge of explosive powder inside of casing 52. The ignition of powder inside of casing 52 propels bullet 20 through barrel 50 and out through muzzle end 50*b* toward the bullet's target (FIG. 14D). As bullet 20 is discharged from barrel 50, a reaction force is applied to casing 52 in the opposite or rearward direction by combustion gases from burning powder, which applies a rearward force to both the nose 30*a* of firing pin 30 and the forward end 26*a* of bolt body 26. This rearward reaction force initiates the reloading and re-cocking sequence.

This rearward reaction force causes bolt body 26 and firing pin 30 (along with bolt carrier 32) begin to move rearwardly in response to the force applied by bullet casing 52. Initially, locking head 28 remains substantially fixed in position relative to frame 14 and fire control housing 16 due to the locking head's mass (inertia), and also because of pin 42 being located in the partial-annular portion 44*a* of groove 44 in the fire control housing 16. Thus, locking head 28 telescopes into bolt body 26 as bolt body 26 begins to move rearwardly (compare FIG. 14C to FIG. 14D), but the rearward motion of bolt body 26 is minimal at first, owing to its own inertia, the inertia of locking head 28, and the positioning of pin 42 in partial-annular portion 44*a* of groove 44. This minimal rearward motion occurs as bullet 20 is traversing barrel 50 and imparts a delay or dwell to the reloading and re-cocking process as the powder burns and bullet 20 is expelled, which enhances accuracy of the bullet by minimizing movement of the firearm's components while the bullet is still in the barrel, and which also limits or substantially prevents the intrusion of burning or burnt powder inside of fire control housing 16 due to premature removal of casing 52 from barrel 50. At this stage, casing 52 begins to move rearwardly with bolt body 26, as extractor 41 holds the casing is a generally fixed position relative to bolt body 26.

As bolt body 26 continues to move rearwardly relative to locking head 28, spring 40 is compressed and pin 36 of bolt body 26 moves rearwardly in the groove 38 of locking head 28. The helical or curved shape of groove 38 causes locking head 28 to rotate relative to bolt body 26 (bolt body 26 does not rotate relative to frame 14 and fire control housing 16) as pin 36 traverses groove 38. The rotation of locking head 28 causes pin 42 of locking head flange 28*b* to rotate in the partial-annular portion 44*a* of groove 44. Rotation of pin 42 in the partial-annular portion 44*a* of groove 44 continues until pin 42 reaches the longitudinal portion 44*b* of groove 44, at which time the "delay" portion of the semiautomatic sequence is complete and pin 42 (and all of bolt assembly 24) is free to traverse rearwardly as pin 42 traverses longitudinal portion 44*b* of groove 44. Spring 40 remains compressed inside bolt body 26, and is held in the compressed state by pins 36, 42 in their respective grooves 38, 44. More specifically, the positioning of pin 42 in the longitudinal portion of groove 44 does not permit locking head 28 to rotate relative to bolt body 26, so that pin 36 is held fixed in groove 38 of bolt body 26 and locking head 28 is thus prevented from telescoping or extending outwardly away from the bolt body 26.

As bolt assembly 24 traverses longitudinally rearwardly, with pin 42 traversing the longitudinal portion 44*b* of groove 44, striker assembly 54 is urged rearwardly by flange portion 28*a* of locking head 28 (FIG. 14E). As springs 90 enter and contact end cap 92, springs 90 are compressed inside of chamber 88 of striker body 86, and inside of striker end cap 92 and its respective chamber 94. After latch nose 60 of sear 56 is drawn downwardly out of engagement with shoulder 86*b* of striker body 86, disconnector spring 84 draws drawbar 58 and tracking projection 66 downwardly out of engagement with striker-release guide channel 64, whereupon tracking projection 66 enters return channel 65 and is drawn forwardly to the start or forward end of guide-channel 64. After tracking projection 66 exits striker-release guide channel 64, sear 56 is free to be urged upwardly in reaction to the force applied by sear spring 70, with tracking projection 66 now located in return channel 65 of sear 56, as directed by disconnector spring 82. Thus, striker assembly 54 slides along latch nose 60 of sear 56 until bolt assembly 24 has pushed striker assembly 54 longitudinally rearwardly to the extent that latch nose 60 re-engages shoulder 86*b* of striker body 86.

As bolt assembly 24 traverses rearwardly to reset striker assembly 54 and re-cock sear 56, extractor 41 retains the bullet casing 52 against the forward end 26*a* of bolt body 26 to draw the spent casing out of the breech 50*a* of barrel 50. As bolt assembly 24 is initially traversing rearwardly its cycle, rear flange 52*a* is held in abutment or close proximity to forward end 26*a* of bolt body, which forces the firing pin's rear end 30*b* to extend rearwardly out of the central bore 35 in locking head 28. Accordingly, striker 54 is initially urged rearwardly by firing pin 30, which travels with and projects rearwardly from locking head 28 due to the location of the casing's rear flange 52*a* at the bolt body's front end 26*a*. As striker 54 compresses striker springs 90, a greater force is applied to firing pin 30 by the striker 54 (and vice versa), which causes the firing pin to translate longitudinally forwardly relative to bolt body 26. In other words, as springs 90 are compressed and striker 54 begins to resist continued rearward motion, the firing pin 30 translates less in the rearward direction than bolt body 26, relative to frame 14 and fire control housing 16. The forward translation of firing pin 30 (relative to bolt body 26) causes the forward nose 30*a* of the firing pin to project through the front end 26*a* of bolt body, so that firing pin 30 applies a force in the forward direction to the central portion of the rear flange 52*a* of the spent casing 52. Because the casing 52 is held along the upper-right surface of rear flange 52*a* by extractor finger 41*a*, the force applied to the central portion of the rear flange 52*a* by firing pin 30 causes the open front end of casing 52 to turn upwardly and outwardly (to the right, as viewed from behind) toward casing ejection aperture 16*a* in fire control housing. This change in orientation of casing 52 causes extractor finger 41*a* to lose its grip of the groove between rear flange 52*a* and casing 52, and casing 52 is ejected out of aperture 16*a* by the force applied by firing pin 30, which acts as a casing ejector, even as bolt assembly 24 continues to travel rearwardly to re-cock striker 54. In addition, any elevated gas pressure in barrel 50 at the time casing 52 is fully extracted from the barrel by extractor 41, such as due to burning powder, may assist in ejecting casing 52 from fire control housing by directing pressurized gases into and around the open front end of the casing and out through casing ejection aperture 16*a*.

Upon ejection of the spent cartridge, magazine spring 53*b* urges a fresh cartridge 33 partially up through the cartridge aperture 55 in frame 14, with the nose of the fresh cartridge directed at breech end 50*a* of barrel 50. During rearward traversal of bolt assembly 24, bolt return springs 34 are compressed so that, upon completion of the rearward travel of bolt assembly 24, return springs 34 urge the bolt assembly 24 to slide forwardly. The forward motion of bolt assembly 24 causes pin 42 of locking head 28 to once again traverse the longitudinal portion 44*b* of groove 44 of fire control housing 16, while locking head 28 remains compressed into bolt body 26 with spring 40 remaining in compression. As bolt assembly 24 moves forward, forward end 26*a* of bolt body engages rear flange 52*a* of the casing 52 of the fresh cartridge 33, and urges the fresh cartridge into breech end 50*a* of barrel 50.

Once pin 42 reaches the partial-annular portion 44*a* of groove 44, pin 42 is free to traverse the partial-annular portion 44*a*, and is biased to do so by the expansion of spring 40 between locking head 28 and bolt body 26, with pin 36 traversing groove 38 to convert the longitudinal expansion force of spring 40 at least partially into a rotational component due to the helical or curved shape of groove 38. As bolt assembly 24 again reaches the maximum extent of its forward travel (i.e., the ready-to-fire position), all of the components of firing mechanism 12 have returned to their ready-to-fire configuration, such as shown in FIGS. 1 and 8A. Once trigger 22 is released, drawbar return spring 82 urges drawbar 58 and trigger 22 forward to their ready-to-fire configuration, whereupon tracking projection 66 is re-set in striker-release guide channel 64, and sear 56 is once again ready to be pivoted downwardly by actuation of trigger 22 for firing of the next bullet.

In the event that barrel 50 is empty and an operator wishes to load a fresh cartridge 33 from magazine 53 into the barrel, this may be accomplished by pulling or "racking" the manual bolt actuator 96 rearwardly to cycle the bolt assembly 24 through substantially the same motions described above with reference to semiautomatic operation of firing mechanism 12. Upon release of manual bolt actuator housing 100, bolt return springs 34 draw bolt assembly 24 forwardly and urge a fresh cartridge into barrel 50. In the event that striker 54 and sear 56 need to be re-cocked for firing, manual bolt actuator 96 is pulled rearwardly with sufficient additional force to compress both bolt return springs 34, striker springs 90, and sear spring 70 so that the latch nose 60 engages the front recessed portion or shoulder 86*b* of striker assembly 54. Thus, chambering a first cartridge and/or re-cocking the striker and sear may require significantly less effort or force than in other, similarly-sized firearms, and particularly if striker 54 is left in a cocked position, because only the relatively low spring coefficient bolt return springs and the spring 40 inside bolt body 26 are compressed during manual cycling of the firing mechanism.

It will further be appreciated that striker assembly 54, including springs 90, and sear 56 may be configured so that firearm 12 may be left or stored indefinitely with striker assembly 54 and sear 56 in a cocked and read-to-fire position, without substantial degradation of springs 90 and without risk of striker assembly 54 or sear 56 being impacted or contacted in an unintentional manner that would cause the sear to inadvertently release the striker assembly, as these components are internal to frame 14 and fire control housing 16.

Because of the compactness and relative light weight of the components of firing mechanism 12, because of the energy absorption characteristics of bolt assembly 24 that reduces the need for strong bolt return springs, and because of the use of separate springs or biasing members for driving the striker and for returning the bolt assembly, for example, a firearm incorporating the firing mechanism of the present invention typically exhibits greater ease of use, improved accuracy, and faster cycling or semiautomatic operation. Ease of use is improved over prior designs because of the ease with which a fresh cartridge may be loaded into an empty barrel, using relatively low pullback forces, for example. Prior designs may include heavy steel slides and/or heavy or high spring coefficient springs to absorb recoil energy and/or to reload and re-cock a firing mechanisms. These heavier components move more slowly than lighter components due to their inertia, and can further reduce accuracy of subsequent shots after a first bullet is fired. The inertia of the larger and heavier components of prior designs, which are typically mounted high on the firearm and cycle rearward and forward after each shot fired, which typically causes a firearm that is gripped below the barrel to rise after each shot in a phenomenon known as "muzzle flip." In contrast, embodiments of the firing mechanism of the present invention lack a moving fire control housing or other potentially heavy moving parts so that muzzle flip is minimized. The lighter and smaller components of the present firing mechanisms' components also enables it to cycle more quickly than heavier designs.

Thus, it will be appreciated that the semiautomatic firing mechanism of the present invention provides a compact design for imparting dwell to a semiautomatic firearm, which improves the accuracy of the firearm while minimizing the number of external moving parts and entry points into the weapon through which contaminants may be introduced. The barrel is held substantially fixed and stationary within the fire control housing, and moving parts are low in weight and internal to the fire control housing, to improve accuracy of the firearm. The lack of a moving fire control housing improves safety for a user, and enables a firearm incorporating the firing mechanism to be used in close spaces without entangling or impacting surrounding objects or materials with a moving slide or housing. It will further be appreciated that the firing mechanism of the present invention may be adapted for fully automatic operation, such as by modifying the trigger mechanism to release the striker once the bolt assembly has re-set to its ready-to-fire position with a fresh cartridge in the barrel.

Changes and modifications in the specifically described embodiments can be carried out without departing from the principles of the present invention, which is intended to be limited only by the scope of the appended claims, as interpreted according to the principles of patent law, including the doctrine of equivalents.

The invention claimed is:

1. A firing mechanism for a firearm, said mechanism comprising:

a fire control housing defining a longitudinal bore;

a bolt assembly movably disposed in said longitudinal bore of said fire control housing, said bolt assembly comprising a bolt body and a locking head movably disposed at said bolt body, said locking head configured to simultaneously rotate and longitudinally translate relative to said bolt body;

a first rotational engaging member disposed along an inner surface of said longitudinal bore of said fire control housing;

a second rotational engaging member disposed along an outer surface of said locking head, said second rotational engaging member of said locking head configured to engage said first rotational engaging member of said fire control housing to initially permit rotational motion and to subsequently permit longitudinal translation of said locking head relative to said fire control housing when a longitudinal force is applied to said locking head; and wherein a forward end portion of said bolt body is configured to abut the rear end of a bullet cartridge so that firing the bullet cartridge imparts a rearward longitudinal reaction force against said forward end portion of said bolt body, said rearward reaction force causing said bolt body to move rearwardly relative to said locking head, which imparts rotational motion to said locking head, which causes said second rotational engagement member of said locking head to initially rotate relative to said fire control housing and to subsequently translate rearwardly relative to said fire control housing due to engagement with said first rotational engaging member of said fire control housing, to thereby impart a dwell time between firing of the bullet cartridge and substantial rearward movement of said bolt assembly relative to said fire control housing.

2. The firing mechanism of claim 1, wherein said rotational engaging member of said fire control housing comprises a groove having a forward partial-annular portion and a rearward longitudinal portion, and wherein said rotational engaging member of said locking head comprises a radial projection movably disposed in said groove.

3. The firing mechanism of claim 1, further comprising a third rotational engaging member disposed along a surface of said bolt body;

a fourth rotational engaging member disposed along a surface of said locking head; and wherein said fourth rotational engaging member of said locking head is configured to engage said third rotational engaging member of said bolt body to impart rotational motion of said locking head relative to said bolt body when a longitudinal force is applied to said bolt body.

4. The firing mechanism of claim 3, wherein said fourth rotational engaging member comprises a helical groove, and said third rotational engaging member comprises a radial projection extending at least partially into said helical groove.

5. The firing mechanism of claim 1, further in combination with a firearm comprising one of a pistol, a carbine, a rifle, and a shotgun.

6. A firing mechanism for a firearm, said mechanism comprising:

a fire control housing defining a longitudinal bore;

a bolt assembly movably disposed in said longitudinal bore of said fire control housing, said bolt assembly comprising a bolt body and a locking head movably disposed at said bolt body;

a first rotational engaging member disposed along a surface of said bolt body;

a second rotational engaging member disposed along a surface of said locking head, said second rotational engaging member configured to engage said first rotational engaging member of said bolt body to impart rotational motion of said locking head relative to said bolt body when a longitudinal force is applied to said bolt body;

a third rotational engaging member disposed along an inner surface of said longitudinal bore of said fire control housing;

a fourth rotational engaging member disposed along an outer surface of said locking head, said fourth rotational engaging member configured to engage said third rotational engaging member of said fire control housing to initially permit rotational motion and to subsequently permit longitudinal translation of said locking head relative to said fire control housing when a longitudinal force is applied to said locking head; and wherein a forward end portion of said bolt body is configured to abut the rear end of a bullet cartridge so that firing the bullet cartridge imparts a rearward longitudinal reaction force against said forward end portion of said bolt body, said rearward reaction force causing said bolt body to move rearwardly relative to said locking head, which imparts rotational motion to said locking head due to engagement of said first and second rotational engagement members, which causes said fourth rotational engagement member to initially rotate relative to said fire control housing and to subsequently translate rearwardly relative to said fire control housing due to engagement with said third rotational engaging member, to thereby impart a dwell time between firing of the bullet cartridge and substantial rearward movement of said bolt assembly relative to said fire control housing.

7. The firing mechanism of claim 6, wherein said bolt body defines a second longitudinal bore, said locking head being movably disposed in said second longitudinal bolt bore of said bolt body.

8. The firing mechanism of claim 7, said bolt assembly further comprising a firing pin, and said bolt body and said locking head comprising a third longitudinal bore configured to movably receive said firing pin.

9. The firing mechanism of claim 6, wherein said second rotational engaging member comprises a first helical groove, said first rotational engaging member comprises a first radial projection extending at least partially into said first helical groove, said third rotational engaging member comprises a second groove, and said fourth rotational engaging member comprises a second radial projection extending at least partially into said first helical groove.

10. The firing mechanism of claim 9, wherein said second groove comprises a forward partial-annular portion configured to permit rotational motion of said second radial projection and a rearward longitudinal portion configured to permit longitudinal translation of said second radial projection.

11. The firing mechanism of claim 10, wherein said second groove is generally L-shaped.

12. The firing mechanism of claim 6, further comprising a biasing member disposed between a portion of said bolt body and a portion of said locking head and configured to urge said bolt body and said locking head longitudinally away from one another.

13. The firing mechanism of claim 6, further in combination with a trigger mechanism comprising a striker and a sear, said sear configured to hold said striker in a ready-to-fire state until being released by actuation of said trigger mechanism.

14. The firing mechanism of claim 13, wherein said striker comprises:

a striker head;

a striker rear section telescopingly coupled to said striker head;

a biasing member disposed between respective portions of said striker head and said striker rear section; and wherein said biasing member is configured to urge said striker head longitudinally outwardly away from said striker rear section in a telescoping manner.

15. The firing mechanism of claim 14, wherein said striker head and said striker rear section are hollow, and where said biasing member is disposed inside of said striker head and said striker rear section.

16. The firing mechanism of claim 14, wherein said striker further comprises a striker middle section disposed between and in telescoping engagement with said striker head and said striker rear section.

17. The firing mechanism of claim 16, wherein at least one of said striker head, said striker rear section, and said striker middle section comprises a slot configured to facilitate air flow into and out of said striker during telescopic movement of said striker head relative to said striker rear section.

18. The firing mechanism of claim 6, further in combination with a firearm comprising one of a pistol, a carbine, a rifle, and a shotgun.

19. The firing mechanism of claim 6, wherein said bolt assembly further comprises a bolt carrier, said bolt carrier comprising a pair of rails extending longitudinally forwardly from said bolt body.

20. The firing mechanism of claim 19, further comprising a bolt return spring at said bolt carrier, said bolt return spring configured to urge said bolt carrier and said bolt body forwardly.

21. A firearm comprising:

a trigger mechanism and a firing mechanism, said firing mechanism comprising:

a fire control housing defining a longitudinal bore;

a bolt assembly movably disposed in said longitudinal bore of said fire control housing, said bolt assembly comprising a bolt body and a locking head movably disposed at said bolt body, said locking head configured to simultaneously rotate and longitudinally translate relative to said bolt body;

a rotational engaging member disposed along an inner surface of said longitudinal bore of said fire control housing;

another rotational engaging member disposed along an outer surface of said locking head, said rotational engaging member of said locking head configured to engage said rotational engaging member of said fire control housing to initially permit rotational motion and to subsequently permit longitudinal translation of said locking head relative to said fire control housing when a longitudinal force is applied to said locking head; and wherein a forward end portion of said bolt body is configured to abut the rear end of a bullet cartridge so that firing the bullet cartridge imparts a rearward longitudinal reaction force against said forward end portion of said bolt body, said rearward reaction force causing said bolt body to move rearwardly relative to said locking head, which imparts rotational motion to said locking head, which causes said rotational engagement member of said locking head to initially rotate relative to said fire control housing and to subsequently translate rearwardly relative to said fire control housing due to engagement with said rotational engaging member of said fire control housing, to thereby impart a dwell time between firing of the bullet cartridge and substantial rearward movement of said bolt assembly relative to said fire control housing.

22. The firearm of claim 21, wherein said trigger mechanism further comprises:

a striker assembly configured to strike a firing pin of said firing mechanism;

a sear configured to selectively hold said striker assembly in a cocked configuration;

a drawbar configured to selectively move said sear to release said striker assembly from said cocked configuration; and a trigger coupled to said drawbar and configured to actuate said drawbar to release said striker assembly.

23. The firearm of claim 22, wherein said striker assembly comprises:

a hollow striker head;

at least one biasing member disposed in said hollow striker head, said at least one biasing member comprising a pair of coil springs including a smaller-diameter spring disposed inside of a larger-diameter spring; and wherein said biasing member is held in compression substantially inside of said hollow striker head prior to release of said striker assembly.

* * * * *

UNITED STATES PATENT AND TRADEMARK OFFICE

CERTIFICATE OF CORRECTION

PATENT NO. : 8,356,543 B2
APPLICATION NO. : 12/894509
DATED : January 22, 2013
INVENTOR(S) : Rosol et al.

It is certified that error appears in the above-identified patent and that said Letters Patent is hereby corrected as shown below:

On the Title Page

"(73) Assignee: Defense Deisigns, LLC, Ada, MI (US)"
Should be --[73] Assignee: Defense Designs, LLC, Ada, MI (US)--

Signed and Sealed this
Seventh Day of January, 2014

Margaret A. Focarino

Margaret A. Focarino
*Commissioner for Patents of the United States Patent and Trademark Office*